US006951193B1

(12) United States Patent
Draper

(10) Patent No.: US 6,951,193 B1
(45) Date of Patent: Oct. 4, 2005

(54) FILM-COOLED INTERNAL COMBUSTION ENGINE

(76) Inventor: Samuel D. Draper, 4 Cardiff Ct., Simpsonville, SC (US) 29861

( * ) Notice: Subject to any disclaimer, the term of this patent is extended or adjusted under 35 U.S.C. 154(b) by 0 days.

(21) Appl. No.: 10/379,298

(22) Filed: Mar. 3, 2003

Related U.S. Application Data

(60) Provisional application No. 60/360,369, filed on Mar. 1, 2002.

(51) Int. Cl.[7] ..... F01P 3/02
(52) U.S. Cl. ..... 123/41.17
(58) Field of Search ..... 123/41.17, 41.57

(56) References Cited

U.S. PATENT DOCUMENTS

| | | | | |
|---|---|---|---|---|
| 2,016,921 A | * | 10/1935 | Goddard | 60/39.55 |
| 2,819,704 A | * | 1/1958 | Niederman | 123/41.17 |
| 2,853,061 A | * | 9/1958 | Elsbett | 123/41.17 |
| 2,855,910 A | * | 10/1958 | De Waern | 123/41.17 |
| 3,489,206 A | | 1/1970 | Lecourt | |
| 4,040,400 A | | 8/1977 | Kiener | |
| 4,083,331 A | * | 4/1978 | Guenther | 123/41.17 |
| 4,654,983 A | | 4/1987 | Graham et al. | |
| 4,995,349 A | | 2/1991 | Tuckey | |
| RE34,143 E | | 12/1992 | Rao et al. | |
| 5,168,706 A | | 12/1992 | Kawamura | |
| 5,454,426 A | | 10/1995 | Moseley | |
| 5,641,273 A | | 6/1997 | Moseley | |
| 6,098,577 A | | 8/2000 | Wu | |
| 6,102,658 A | | 8/2000 | Kvasnak et al. | |
| 6,270,317 B1 | | 8/2001 | Manning et al. | |
| 6,379,118 B2 | | 4/2002 | Lutum et al. | |
| 6,698,388 B2 | | 3/2004 | Brace et al. | |
| 6,705,831 B2 | | 3/2004 | Draper | |

OTHER PUBLICATIONS

Mike Fry et al., "A Comparison of Gasoline Direct Injection Systems and Discussion of Development Techniques", Society of Automotive Engineers, Inc., International Congress and Exposition, Detroit, Michigan, Mar. 1–4, 1999, 16 pages.

* cited by examiner

*Primary Examiner*—Henry C. Yuen
*Assistant Examiner*—Jason Benton
(74) *Attorney, Agent, or Firm*—Christie, Parker & Hale, LLP

(57) ABSTRACT

This invention provides a film-cooled internal combustion engine in which a film of gas is applied to interior surfaces of the engine to reduce heat transfer to the metal components of the engine from hot combustion gases to cause more work to be extracted from those gases, thereby raising the efficiency of the engine. In one form, this objective is achieved by reducing the temperature of the gas coming in contact with the metal parts during the power stroke of the engine by laying down a thin film of gas between the hot combustion gases and the walls of the engine. This thin film of gas creates an effectively lower film temperature-driven convection heat transfer. This invention reduces heat transfer to walls of the engine, protects hot parts, reduces knock (pre-ignition), and purges fuel from tight spaces in the engine.

19 Claims, 17 Drawing Sheets

FIG. 1
CYLINDER WITH PISTON NEAR BOTTOM OF TRAVEL
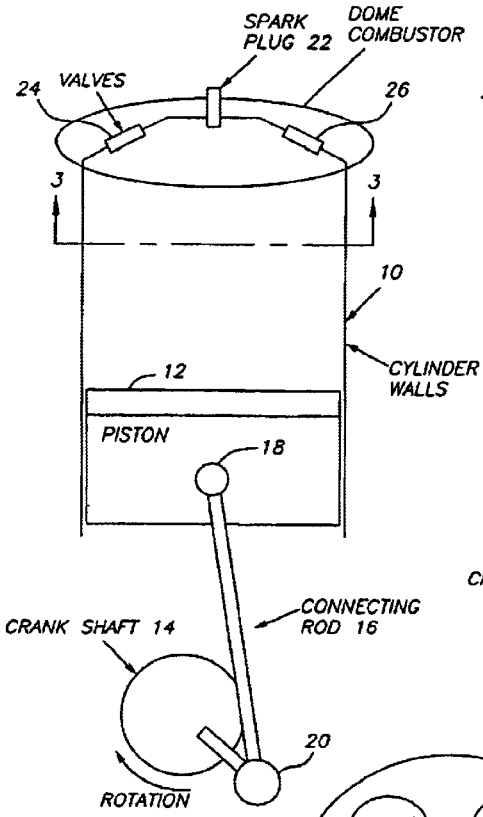
FIG. 2
CYLINDER WITH PISTON NEAR TOP OF TRAVEL
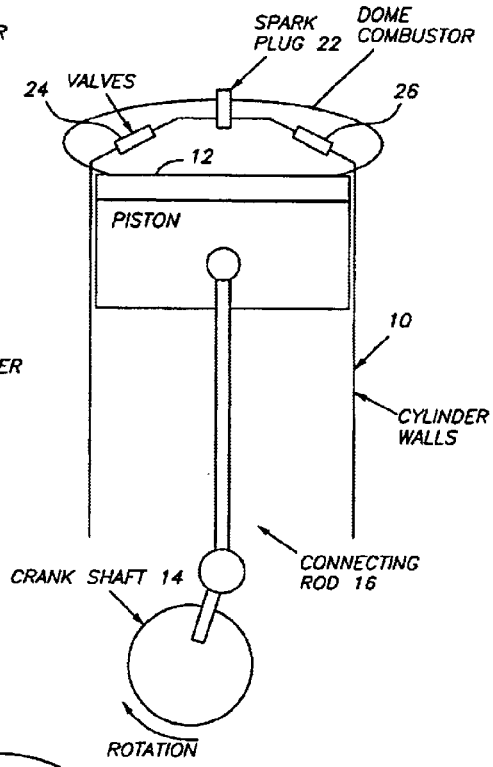
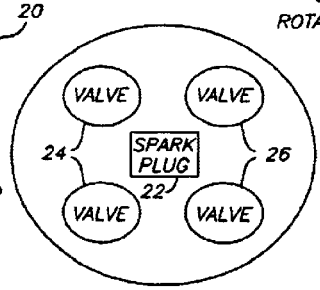
FIG. 3

ZOOMED IN VIEW OF CYLINDER WITH PISTON NEAR TOP OF TRAVEL

5 STAGES OF IC ENGINE CYCLE WITH CRANK ANGLE

FIG. 6
COMBUSTING GASES HIT EVERY SURFACE IN CYLINDER
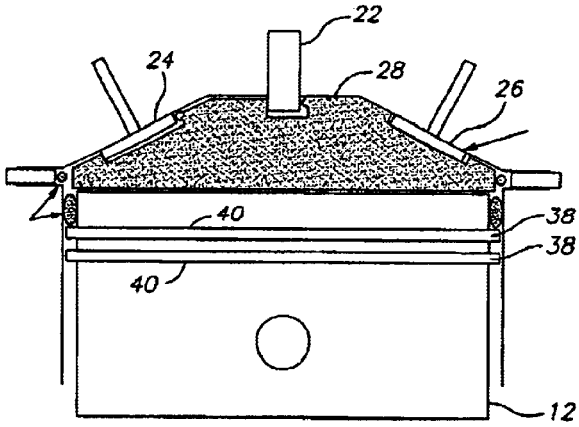
FIG. 7
MODERN INTERNAL COMBUSTION ENGINE ENERGY DISTRIBUTION
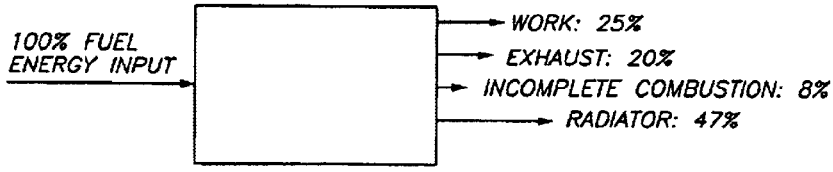
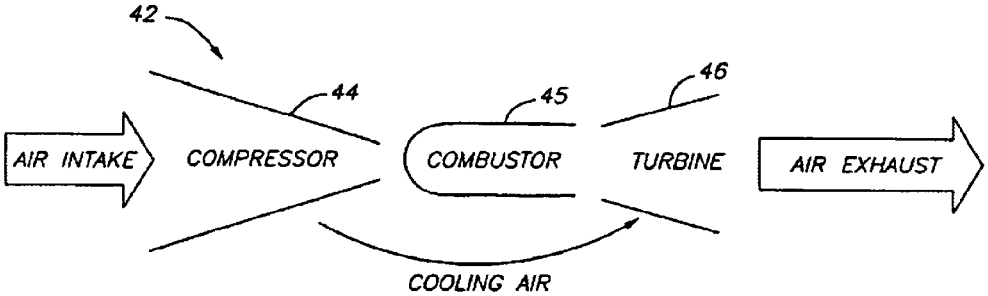
FIG. 8
GAS TURBINE ENGINES

FILM COOLING IN HIGH-SPEED FLOWS

FILM COOLING IS INJECTION OF AIR IN THIN LAYER AGAINST SURFACE TO BE PROTECTED FROM HOT GASES

IMPINGEMENT FILM COOLING

VARIATIONS OF IMPINGEMENT FILM

ANGLED IMPINGEMENT

SLOT IMPINGEMENT

FILM-COOLED INTERNAL COMBUSTION ENGINE SYSTEM

HEAT TRANSFER AND DESIRED FILM COOLING TIME

EFFECT OF SINGLE FILM HOLE ON CYLINDER

EFFECT OF SINGLE FILM HOLE

EFFECT OF FILM HOLE PATTERN ON CYLINDER

EFFECT OF FILM HOLE PATTERN

FILM-COOLED INTERNAL COMBUSTION
ENGINE ENERGY DISTRIBUTION

FILM PLENUM IN PISTON HEAD AT BOTTOM

FILM PLENUM IN THE PISTON HEAD AT TOP

PISTON FILM PLENUM

FILM-COOLED INTERNAL COMBUSTION ENGINE

CROSS-REFERENCE TO RELATED APPLICATION

This application claims priority to Provisional Application No. 60/360,639, filed Mar. 1, 2002, and which is incorporated herein by reference.

SUMMARY OF THE INVENTION

This invention relates generally to internal combustion engines, and more particularly to an improved efficiency film cooled internal combustion engine.

BACKGROUND OF THE INVENTION

Internal combustion (IC) engines have been used for many years to convert chemical energy stored in fuels to mechanical energy. The main components of an IC engine are a cylinder in an engine block, a reciprocating piston in the cylinder, a rotatable crankshaft, and a connecting rod, which transfers energy from the reciprocating piston to the rotating crankshaft.

The best automotive IC engines run at about 26% thermal efficiency at peak operating conditions. The remaining energy is lost through convection to the engine block, heat in the exhaust gas and unburned fuel. Almost half of the available energy from the fuel is lost through the heat convected to the engine block and removed by the engine radiator. About 8% of the potential energy is lost due to incomplete combustion of fuel in the cylinder.

Industry has long sought ways to reduce the heat transfer from the combusting gases to the engine block to get more mechanical power, increase life of engine parts, and obtain higher combustion temperature. For example, thermal barrier coatings have been applied to the inside of the cylinder, but those coatings rubbed off as the piston reciprocated in the cylinder.

In addition to saving fuel, reducing the heat transfer from combusting gases to the engine block also has application for the military where reduced thermal signatures are critical.

For many years, gas turbine engines have used "film cooling", i.e., cooling with a flowing film of cool air, to reduce transfer of heat by convection from combusting gases to the combuster walls. The flowing film of cool air against the protected surface permits operating the gas turbine at higher, and therefore more efficient, temperatures. Film cooling is also used on the outside of the turbine airfoils to achieve higher operating temperature and efficiency.

The inherent disadvantages of IC engines (both Diesel and gasoline) are reduced by the present invention, which uses film cooling to reduce heat transfer to the engine block, increase life of engine components, improve fuel combustion efficiency, and increase engine compression ratio. Film cooling applied to IC engines in accordance with this invention provides increased engine combustion temperature, increased shaft power, reduced fuel flow to the engine, or any combination thereof.

SUMMARY OF THE INVENTION

An IC engine in accordance with this invention includes a cylinder having a-wall, a piston which reciprocates in the cylinder, inlet and outlet valves in the cylinder, and means for opening and closing the valves as the piston reciprocates and periodically passes through intake, compression, combustion, expansion, and exhaust phases. A supply of compressed gas delivers film cooling gas through at least one film hole via a cooling channel which passes from the exterior to the interior of the cylinder wall. The compressed gas flows through the film hole and against the interior surface of the cylinder wall to provide a layer or film of cool gas between the combustion gases and the cylinder wall to decrease transfer of heat through the wall. In the presently preferred embodiment of this invention, the compressed gas is exhaust gas produced by the engine in order to not alter the fuel to oxygen ratio in the combustion chamber, or introduce oxygen that will not combust, interfering with catalytic converter operation. Alternatively, the compressed gas can be air, but this is not preferred when the engine exhaust gas is treated by passing it through a catalytic converter which cannot handle oxygen.

Preferably, a control valve in a supply line which connects the compressed gas to the cooling channel is operated by a controller which opens and closes the central valve so that cooling gas is supplied to the interior of the cylinder during the compression, combustion, or expansion phases of engine operation.

In another preferred form of the invention, the piston includes at least one film hole and cooling channel, which receives compressed gas from a supply conduit extending through the cylinder wall adjacent the piston to deliver film gas from the supply of compressed gas to the cooling channel and film hole in the piston. In yet another form of the invention, a cooling channel extends through the cylinder wall to deliver gas to tight spaces in the cylinder where unburned fuel tends to be trapped in conventional IC engines. In yet another embodiment, film air is used to reduce the fuel to air ratio in regions of the compressed combustion gases prone to pre-ignition or knock.

These and other aspects of the invention will be more fully understood from the following detailed description and the accompanying drawings.

BRIEF DESCRIPTION OF THE DRAWINGS

FIG. 1 is a schematic diagram of an IC engine with the piston near the maximum displacement from the closed end of the cylinder;

FIG. 2 is a schematic drawing of an IC engine with the piston near the closest point of travel to the closed end of the cylinder;

FIG. 3 is a view taken on line 33 of FIG. 1;

FIG. 6 is a schematic diagram of an IC engine showing tight spaces where fuel tends to collect but not burn during the combusting phase of the engine cycle;

FIG. 7 is a block diagram showing the distribution of energy from an IC engine;

FIG. 8 is a schematic diagram of a gas turbine engine;

DESCRIPTION OF PRIOR ART

Internal Combustion (IC) Engines

Figure 4:
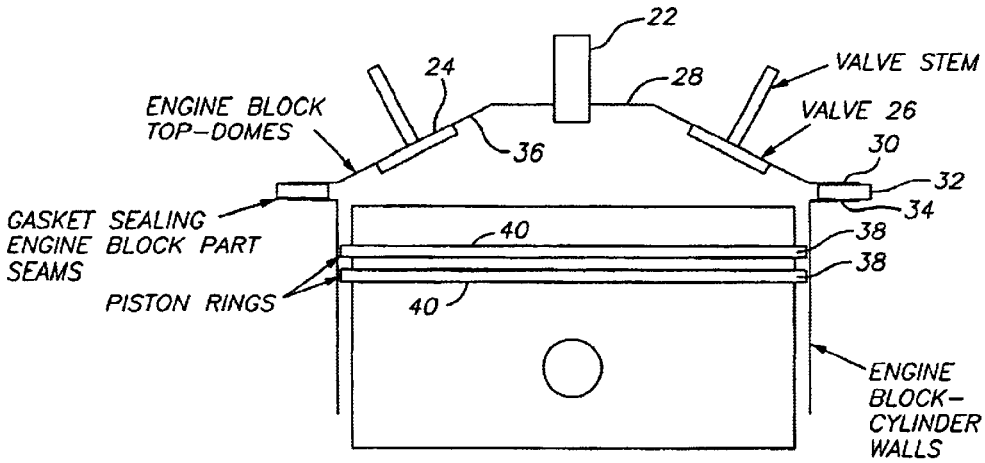
FIG. 4 is an enlarged view of the upper end of the IC engine shown in FIG. 2.

The IC engine is the most widely used mechanical system for converting chemical energy stored in fuels to mechanical shaft energy in low to moderate power levels. The IC engine is used to power automobiles, small aircraft, boats, lawn mowers, small residential electrical generators, and myriad other small power tools. As shown in FIGS. 1 and 2, the main components of an IC engine are a cylinder 10, a cylinder head 11, a reciprocating piston 12, a crankshaft 14, and a connecting rod 16. A wrist pin 18 connects one end of the connecting rod to the piston, and a crank pin 20 connects the other end of the connecting rod to the crankshaft. The piston moves up and down in the cylinder to define a combustion chamber 21 (dome combustor) in the space between the piston and the cylinder head. The motion of the piston up and down in the cylinder is transmitted through the connecting rod to rotate the crankshaft, which is connected to a device (not shown) to extract power.

Most IC engines operate, in a 4 stroke system for each cycle of the engine. That is, the piston travels up and down the cylinder twice, and the crank shaft makes two complete rotations for one cycle of the engine. The cycle is further divided into 5 phases. Starting with the cylinder full of fuel and air and the piston at the bottom, the cycle follows:

1) Compression: The piston travels from the bottom to the top of the cylinder, compressing the gases (a mixture of fuel and air) inside.
2) Combustion: A spark plug 22 in the cylinder ignites the high pressure air and fuel releasing the chemical energy in the mixture raising the pressure and the temperature. If the engine is a diesel, no spark plug is required, because during the compression phase the air and fuel mixture are heated enough to cause ignition of the mixture. This occurs while the air and fuel are in the dome-shaped space at the top of the cylinder, often called the dome combustor, or combustion chamber.
3) Expansion: The high pressures and temperatures of combustion drive the piston down, expanding the gases. The expansion is often called the power stroke because that is when power is extracted from the engine.
4) Exhaust: An exhaust valve 24 connected to the exhaust system (not shown) opens, allowing the burned mixture to exit. The piston travels from the bottom to the top, driving the exhaust from the cylinder.
5) Intake: The valve connected to the exhaust closes, and an intake valve 26 connected to the intake (not shown) opens, allowing a fresh mixture of air and fuel to enter. For engines which use fuel injectors, only air flows through the intake valve. The piston travels from top to bottom, drawing in a fresh supply of air and fuel, and the cycle is ready to begin again.

Figure 5:
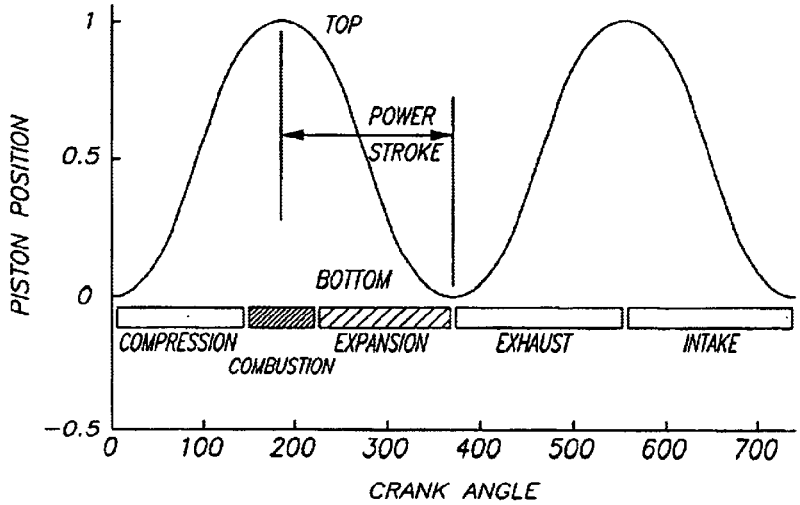
FIG. 5 is a graph showing piston position as a function of crank angle, and the various phases of the engine cycle.

An internal combustion engine often completes this entire cycle several thousand times a minute. Because the speed of the engine varies with use, it is convenient to refer not to time in the engine, but to piston position. Piston position is directly related to the position of the crankshaft. Therefore, the crankshaft angle, or crank angle, is used to plot the motion of the engine through the cycle. FIG. 5 shows the phases and piston positions of the IC engine cycle as a function of crank angle.

Referring to FIG. 4, which is a fragmentary enlarged view of the upper end of the cylinder shown in FIG. 2, the upper end of the cylinder is closed by a cylinder head 28 with an outwardly extending annular flange 30 which seals against an annular gasket 32 and a matching outwardly extending flange 34 formed integrally with the upper end of the cylinder. The cylinder head forms an upper wall portion of the cylinder, and has an inwardly facing concave surface 36 to provide the dome combustor space referred to above. A pair of flexible split piston rings 38 fit in outwardly opening annular grooves 40 in the piston, and make a sliding seal against the interior surface of the cylindrical wall portion of the cylinder.

The hot gases at a high pressure are in the cylinder during only combustion and expansion, about 25% of the total cycle. The remaining time, relatively cool exhaust gas or air moves through the cylinder at relatively low pressures. The cool air actually cools the metal parts of the engine, lowering the temperature of those parts and reducing the need for auxiliary cooling. However, some auxiliary cooling is still required. It usually is provided by the radiator and water cooling system (not shown) in most automobile engines. The cooling system represents one of the inefficiencies of IC engines. Some of the chemical energy released by combusting the fuel is lost to the cylinder walls and radiator before it can be converted to mechanical work by the cycle.

Another source of inefficiency is incomplete combustion. Not all the fuel entering the engine combusts completely, or at the proper time for ideal work extraction. Despite best efforts by designers, the combustion chamber has many tight spaces where fuel collects and therefore does not combust. FIG. 6, which is similar to FIG. 4, shows these areas, which include the spaces between the seal made by the gasket with the cylinder head and the cylindrical wall portion of the cylinder, the spaces around valve seats, the space around the spark plug and cylinder head, and the space between the piston and the cylindrical wall portion of the cylinder.

The final source of inefficiency is entropy generation in the cycle. This entropy generation causes some of the heat released from combustion to be exhausted in the exhaust air. These three sources of inefficiency cause the best gasoline powered IC engines to run about only 25% efficient. FIG. 7 schematically shows the state of the art for IC engines and their energy stream distribution.

Gas Turbine Engines

Gas Turbine Engines are widely used for aircraft power (e.g., jet engines) and for large scale electrical energy production. They operate at steady state conditions by having separate hardware for each part of the work extraction engine cycle. FIG. 8 shows a schematic of a gas turbine engine 42, which includes a compressor 44, combustor 45, and turbine 46.

By separating the functions of compression, combustion, and expansion (turbine) into separate machinery, each piece performs its function continuously, greatly increasing the power output of the gas turbine engine over the IC engine. The separation also permits the air to move constantly through the engine. In modern turbo machinery, the air speeds approach the speed of sound in the hot gas paths. This continuous operation exposes the hot sections of the combustor and turbine to the hot gases continuously. This very hot environment requires extensive cooling. Rather than use the radiator system used in IC engines, gas turbine engines have some of the high pressure compressed air bypass the combustor, and cool the turbine. There is a cycle penalty for having air not go through the combustor, but it is not near the 47% efficiency penalty experienced by the IC engine for cooling.

Figure 9:
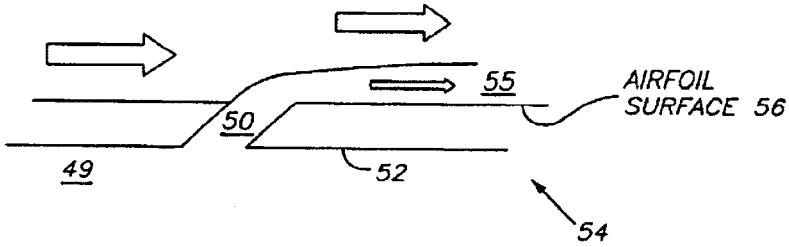
FIG. 9 is a schematic drawing of film cooling on an airfoil surface of a gas turbine engine.

The very hot temperatures experience by turbines required development of film cooling, which uses relatively cool air taken from the compressor to lay down a cool film of air on the outside of the turbine airfoils. FIG. 9 shows the concept of film cooling as executed in the gas turbine engine. Cool air from a cool air reservoir 49 flows through a film hole 50 in a wall 52 of a turbine blade 54, and forms a cool film 55 over an airfoil surface 56 of the blade. The film cooling reduces the temperature seen by the surface of the airfoil. This reduces the heat transfer from the gas path to the airfoil by Newtons law of cooling. Equation (1) is Newtons law of cooling.

$$Q=hA(Tg-Ts) \tag{1}$$

Where Q is the heat transfer rate, h is the heat transfer coefficient, A is the area cooled, Tg is the hot gas temperature, and Ts is the airfoil surface temperature. Incorporating film cooling reduces the effective gas temperature from Tg to Tf.

Due to the discrete nature of film holes and the mixing of the hot gas and the cool air, the film temperature, Tf, is not equal to the coolant temperature, Tc, but is instead a function of the coolant and gas temperatures. Film effectiveness quantifies the quality of the film cooling design. Equation (2) defines film effectiveness.

$$\eta = \frac{T_g - T_f}{T_g - T_c} \tag{2}$$

Figure 10:
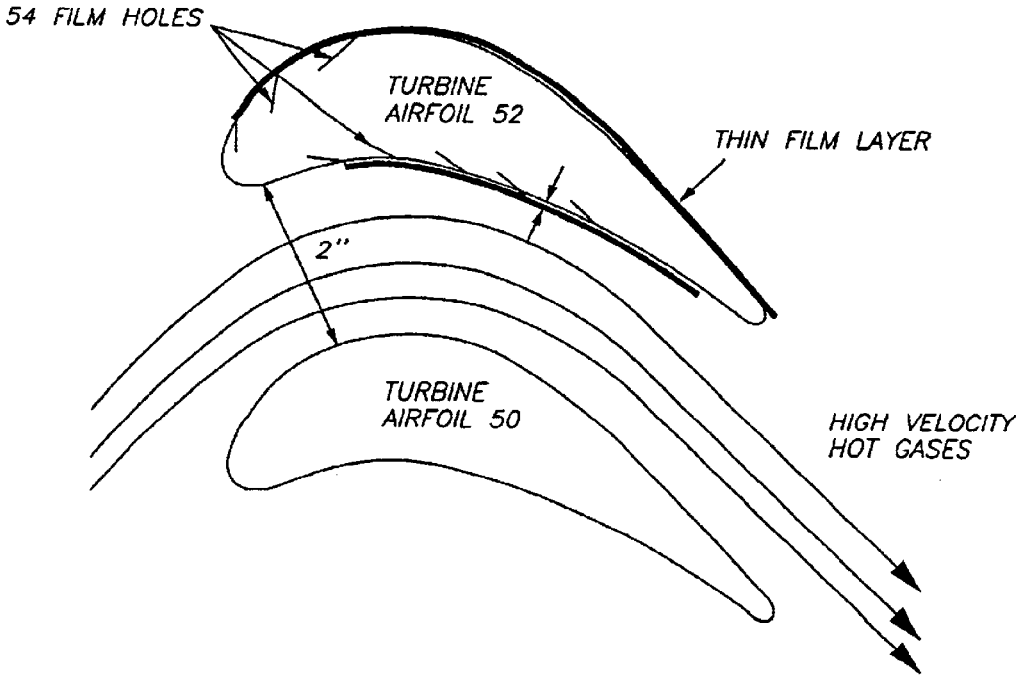
FIG. 10 is a schematic drawing of film cooling turbine airfoil surfaces in a gas turbine engine.

The cool air flows through the film hole in the airfoil because the pressure in the cool air reservoir is higher than the hot gas path pressure. Once in the gas path, the high speed of the gas path air imparts momentum to the cool air, dragging it along the surface of the airfoil. FIG. 10 shows two airfoils 50 and 52. Airfoil 52 has film holes 54 to provide film cooling as described above.

Film effectiveness is a function of the geometry of the film injection pattern and the amount of film flow introduced. Gas turbine experience shows that using 10% of the gas path flow as film flow leads to $\eta_f$=0.6.

Detailed Description of the Invention

Figure 11A:
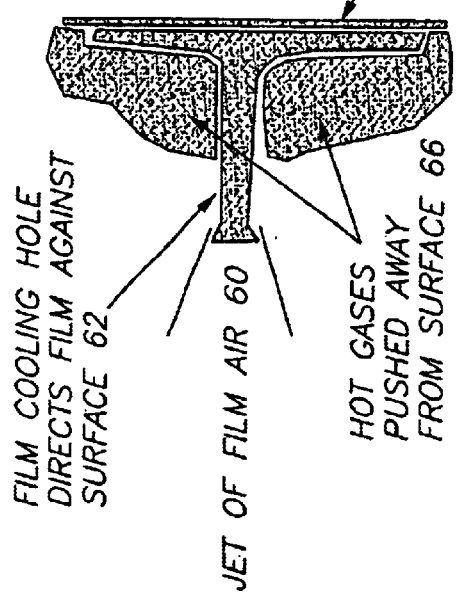
FIG. 11A is a schematic diagram showing film cooling in an IC engine.
Figure 11B:
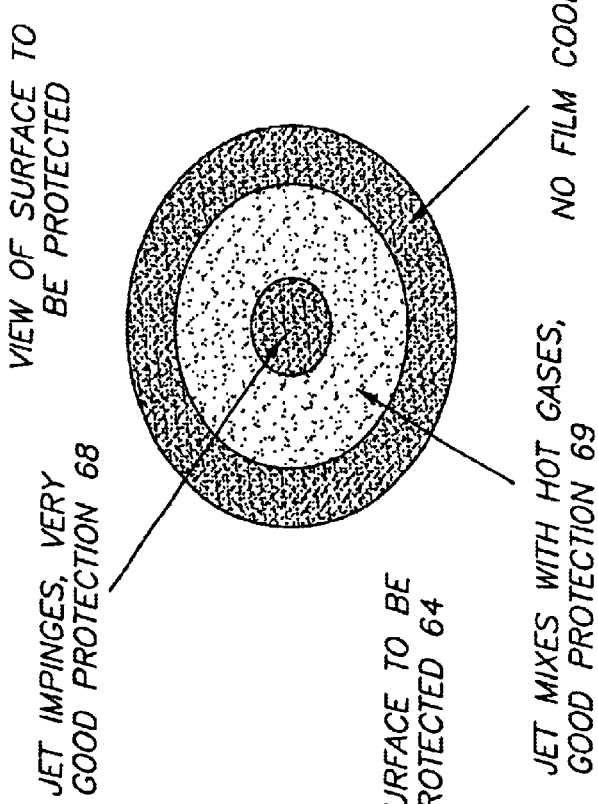
FIG. 11B is a schematic diagram showing the distribution of cooling produced with the apparatus of FIG. 11A.

The prior art gas turbine engine film cooling described above relies on the high speed and momentum of the hot gas path air to direct the film cooling to the surface of the airfoil. In the internal combustion engine, the hot gas path is relatively low speed. This low speed gas path requires different film effects. In the IC engine, the cooling film has to rely on its own momentum to direct it to the surfaces to be cooled. As shown in FIGS. 11A and 11B, this invention uses a jet of cool film air to provide impingement film cooling for cooling critical surfaces of the IC engine. In the embodiment shown in FIGS. 11A and B, a jet 60 of film air flows from a film cooling hole 62 in a direction perpendicular to a surface 64 to be protected. Hot gas 66 is pushed away from the protected surface, resulting in a protected pattern as shown in FIG. 11B. A central circular area 68 receives maximum cooling. An intermediate annular area 69 receives good cooling, and an outer annular area 70 receives little or no cooling.

Figure 12A:
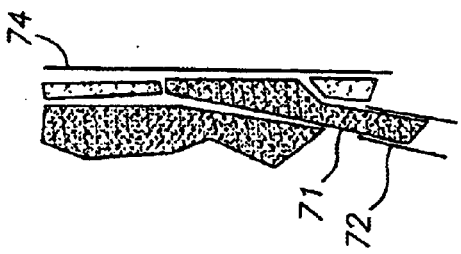
FIG. 12A is a schematic diagram showing film cooling part of an IC engine with air from a circular cooling channel disposed at an angle to the surface to be cooled.
Figure 12B:
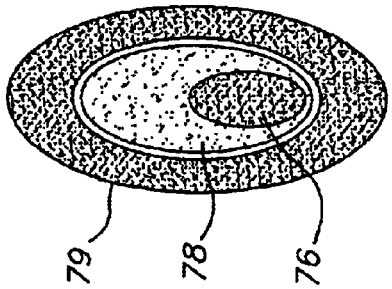
FIG. 12B is a schematic diagram of temperature distribution on the surface cooled with the apparatus of FIG. 12A.

Referring to FIG. 12A, a jet 71 is directed from a round film cooling hole 72 at a shallow angle to a surface 74 to be protected. As shown in FIGS. 12A and 12B, the resulting protecting pattern provides a central elliptical area 76, which receives maximum cooling, an intermediate elliptical area 78 which receives good cooling, and an-outer elliptical area 79, which receives little or no cooling.

Figure 12C:
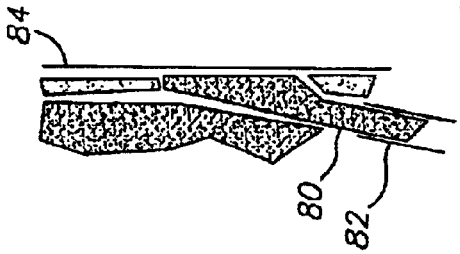
FIG. 12C is a schematic diagram showing film cooling with a cooling channel having a rectangular outlet and disposed at an angle to the surface to be cooled in an IC engine.
Figure 12D:
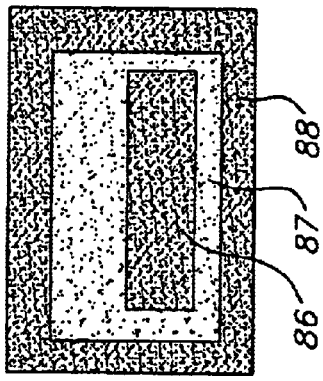
FIG. 12D is a schematic drawing of temperature distribution on the surface cooled by the apparatus of FIG. 12C.

Referring to FIGS. 12C and D, a jet of cooling air 80 flows from a film cooling hole 82 in the shape of a rectangular slot, and at a shallow angle, against a surface 84 which is to be protected. The resulting cooling pattern is shown in FIG. 12B. An inner rectangular area 86 receives maximum cooling, an intermediate annular rectangular area 87 receives good cooling, and an outer rectangular perimeter 88 receives little or no-cooling.

As is clear from the foregoing description, the film cooling impingement jet does not have to be normal to the surface, or be round. In FIGS. 12A–C, the impingement jet is not normal to the surface. This may be required due to the geometry of the walls, or is preferred. In FIG. 12C, the jet is angled, and the film hole is a slot rather than a hole. The slot provides a uniform, wide film coverage. The film hole can converge, diverge, be shaped, round, slot, normal, or at a shallow angle to the surface. The literature on film cooling for gas turbine engines is rich with film hole geometries and manufacturing techniques which apply here.

IC engine components run relatively cool because the hot gases are in the engine for only about 25% of the time. Increasing the gas temperatures to get greater thermal efficiency is limited by pre-ignition in gasoline engines, but not in diesel engines. Moreover, internal combustion engines do not normally have a supply of compressed air to use for film cooling, as in gas turbine engines. All of these reasons have led to relatively low-technology cooling systems for IC engines that do not include film cooling.

The motivation for film cooling internal combustion engines is-different from that for gas turbine engines. The internal combustion engine looses about half the fuel energy to convection through the walls to the radiator. Many technologies have tried to reduce this convection, or make use of the heat once it has convected. The use of thermal barrier coatings offered insulation to the inside of the cylinder, but these coatings were fragile and they simply rubbed off when the piston went by, permitting loss of heat from the cylinder. Once the heat leaves the hot gases, its temperature drops dramatically (2500° K to 500° K). This reduction in temperature results in a large increase in entropy, and the resulting decrease in availability makes the heat of little use.

Figure 13:
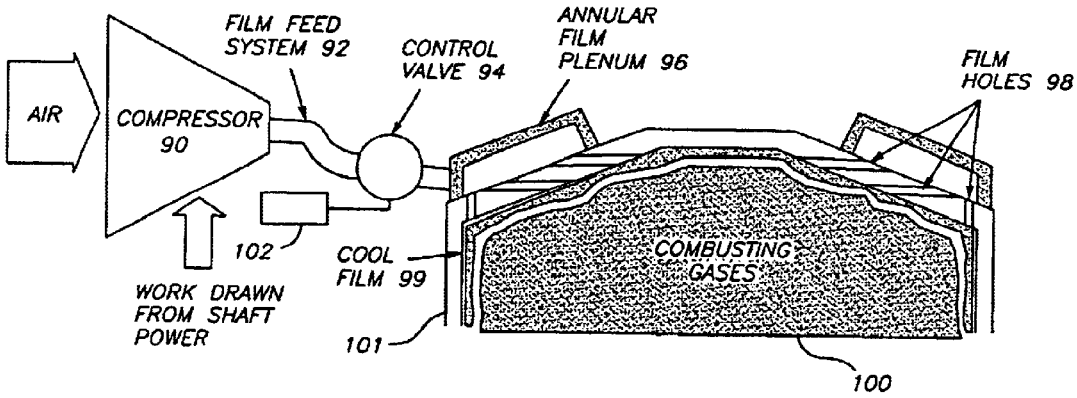
FIG. 13 is a schematic diagram of a film-cooled IC engine system using air as the cooling gas.
Figure 14:
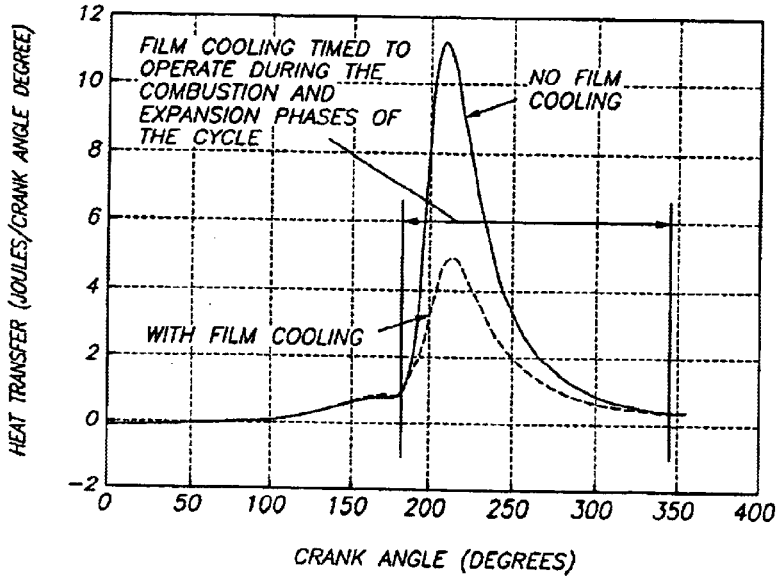
FIG. 14 is a graph showing heat transfer as a function of crank angle with film cooling and without film cooling in an IC engine.

As shown in FIG. 13, for most IC engines, film cooling in accordance with the present invention requires a compressor 90, a film feed system 92, a control valve 94, a film plenum 96, and film holes 98 to supply a cooling film of air 99 to isolate combustion gases 100 from the cylinder wall 101. To get more cooling from the air film, the film feed system includes a cooler (not shown). The compressor produces pressures greater than those seen in the engine to inject cool air into the combustion chamber during the compression, combustion, or expansion phases. The film feed system delivers compressed air from the compressor to the engine cylinder walls. The control valve allows compressed air to flow only during the compression, combustion, or expansion phases of engine operation. The film manifold delivers the compressed air to the film holes, which are strategically placed to inject cool air to proper locations inside the engine cylinder. For film cooling to reduce heat transfer to the surface, and not adversely affect the engine cycle, the film is injected during the highest heat load portions of the cycle. FIG. 14 shows the heat load during the compression, combustion, and expansion phases of the engine with and without the film cooling of this invention. The exhaust and intake phases deal with cool air and do not require film cooling. For engines which do not require a catalytic converter, or which use a converter not adversely affected by the presence of oxygen in the exhaust gases, a cooling film of air is acceptable. Otherwise, exhaust gas (with little or no oxygen present) is used as described below with reference to FIG. 25.

Compressor

Figure 15:
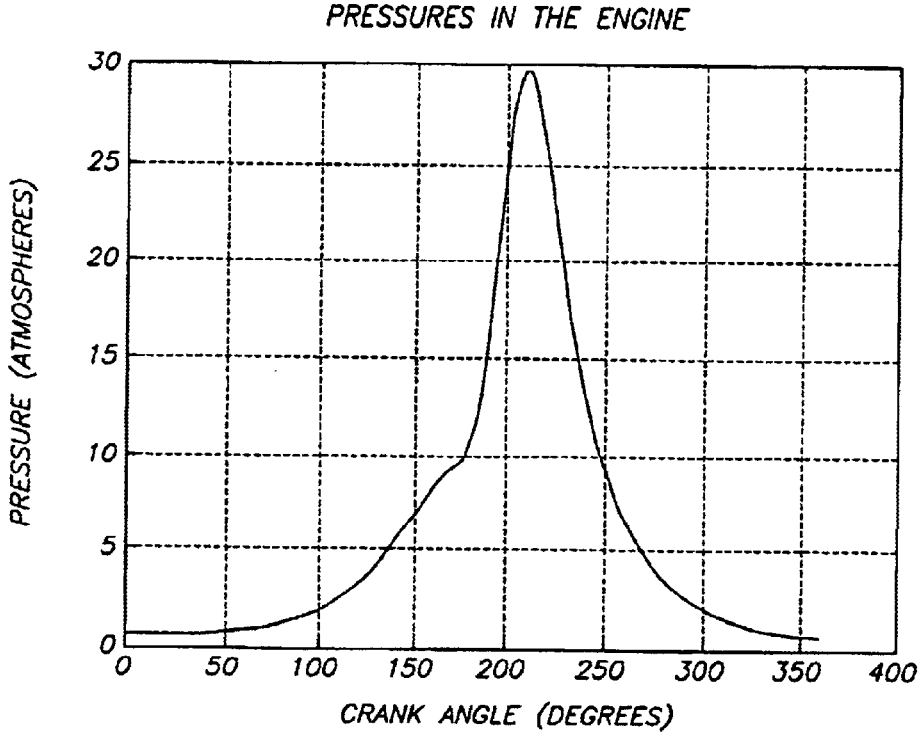
FIG. 15 is a graph of pressure in an IC engine as a function of crank angle.

The compressor is sized to deliver air at the flow rate and pressure required to overcome the pressures in the engine. FIG. 15 shows the pressures in the engine at various crank angles.

The compressor overcomes the highest pressure and supplies cooling air at sufficient pressure to develop the impingement velocities required. A pressure up to about 35 atmospheres is sufficient for most IC engines. In those cases where maximum film cooling is not required, and cost saving is desired, cooling air is supplied only during lower pressure times, say, between about 5 atmospheres and about 25 atmospheres. This permits' the use of a lower cost compressor. For multi-cylinder engines, preferably one compressor supplies air film to all the cylinders to reduce engine complexity.

The compressor is driven by an accessory belt (not shown) on the engine, or attached directly to the drive shaft, or powered by electricity provided by the alternator (not shown), or powered by any other suitable means.

Film Feed System

Once the air is compressed, it is delivered to the cylinder. The air film feed system 92 consists of pipes or hoses (not shown), or is incorporated as channels in the engine block. The feed system divides the flow from the compressor to the plurality of cylinders in a multi-cylinder engine. After compression, the film air is hot, so the feed system preferably includes cooling fins (not shown) or a cooler 93 for the film air. The film feed pipes or hoses can also be in the engine radiator (not shown) coolant.

Control Valve

The opening and closing of the control valve 94 is timed to deliver the film cooling air to the cylinder at the proper time, i.e., during the combustion and expansion phases of the cycle. FIG. 14 shows the preferred time (crank angle) for allowing air to feed the film cooling system. The control valve is operated s0 a cooling film of air is delivered during that time, namely, during the compression, combustion or expansion phases. For multi-cylinder engines, more than one control valve is used because of the different phases of the engine cylinders. Moreover, if some of the film cooling holes direct air film toward the spark plug (as described below), those holes begin providing film cooling later than the other holes. Additional control valves are provided for this purpose.

The control valve preferably is an electronic valve controlled by an engine electronic controller 102 similar to the controller for fuel injectors (not shown). Alternatively, the control valves are controlled mechanically, say by cam action off the engine cam shaft (not shown), or are mechanical valves operated by rods, as with the engine valves. In any event, the controller 102 responds to the crankshaft angle through a suitable mechanical or electronic linkage shown as a dashed line 103 in FIG. 13.

Film Plenum

Once the air film passes from the compressor and through the control valve(s), it fills the plenum 96 used to supply cooling air film holes 98. Preferably, a plurality of plenums are placed around the cylinder and dome combustor, depending on the arrangement required for the film cooling holes. The plenums can be large enough to have low velocity flow, or small to provide high velocity flow. The plenums can be annular or discrete, and they can run the entire length of the cylinder, or be distributed around the cylinder.

Film Holes

Figure 16:
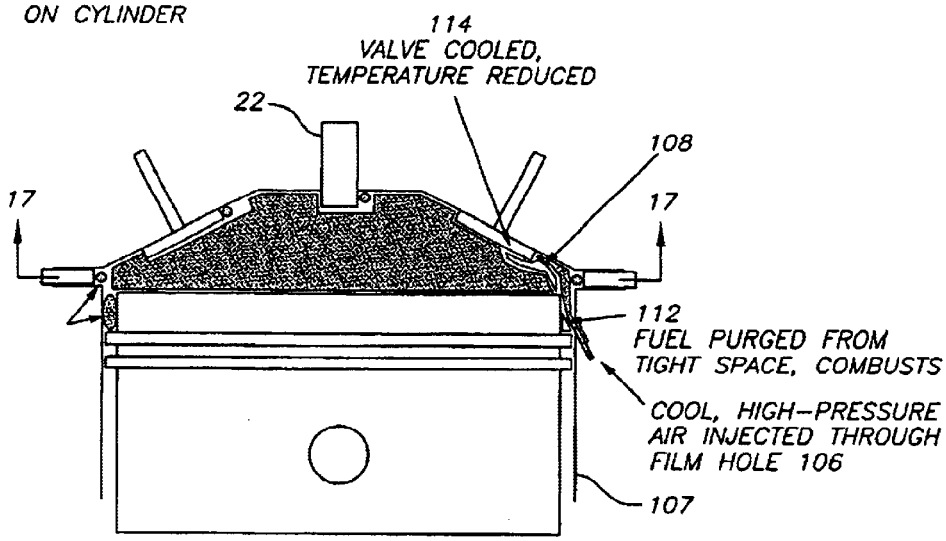
FIG. 16 is a block diagram showing film cooling in the space between the piston head and cylinder during the combustion phase of the engine cycle.
Figure 17:
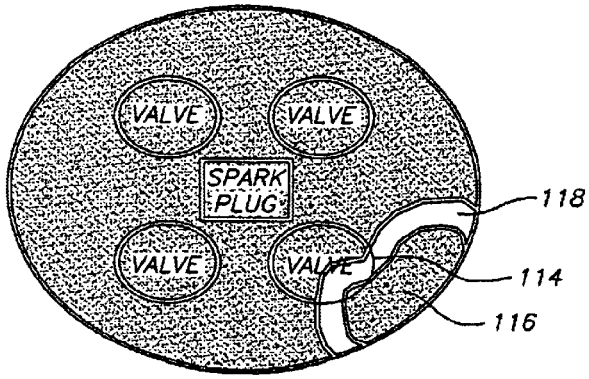
FIG. 17 is a view taken on line 17—17 of FIG. 16.

Each cylinder in the film-cooled IC engine of this invention has one or more film cooling holes 98. For simplicity, only a few film holes are shown in describing this invention. The thermal load, film decay rate, and internal cooling features dictate the pattern of the film cooling holes. Following the concepts described above with respect to cooling air films injected into relatively low air speed gas flow of IC engines, FIGS. 16 an 17 show how one film hole .106 through a cylinder 107 injects a cooling film 108 between a piston head 110 and the cylinder to purge fuel from a tight space 112, and displace hot gas 109 from adjacent a valve 114, thereby increasing valve life, and burning fuel which would otherwise be wasted. Referring to FIG. 17, maximum cooling occurs in an area 116 where the cooling film enters the cylinder, and is effective over an area 118, which extends to part of the valve. Adding more film holes 120 of different sizes and flowing different amounts of cooling air around the cylinder, in the dome combustor, and on the piston as shown in FIG. 18 produces the film cooling pattern shown in FIG. 19.

Figure 18:
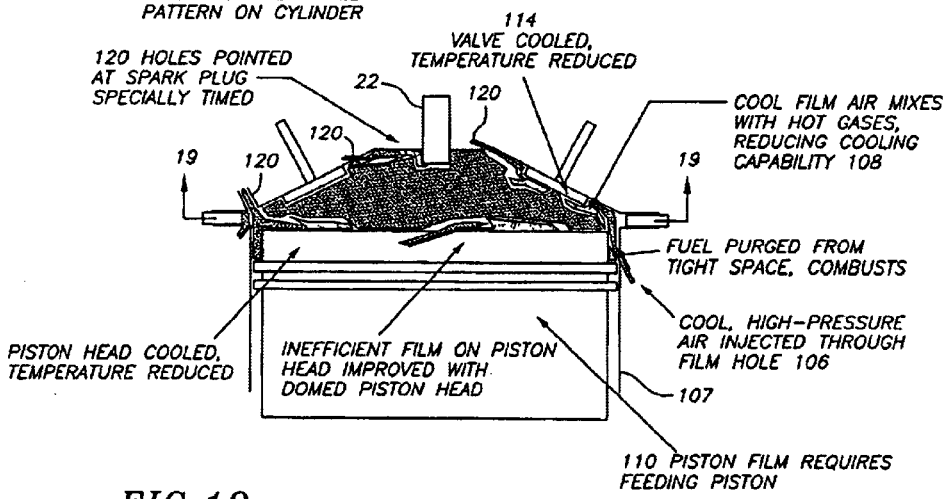
FIG. 18 is a schematic block diagram showing the effect of multiple film holes for cooling an IC engine.
Figure 19:
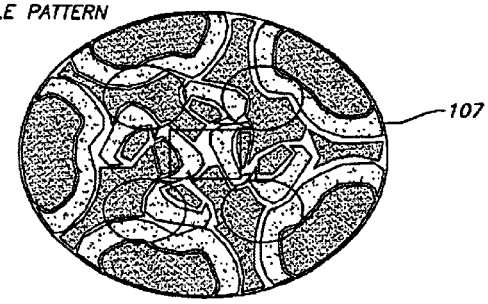
FIG. 19 is a view taken on line 19—19 of FIG. 18.

The pattern of FIGS. 18 and 19 purges fuel from all the tight spaces, covers much of the dome combustor, some of the cylinder walls, and some of the piston head. As described in more detail below with respect to FIGS. 22–24, more film holes placed lower on the cylinder walls cool the walls while the piston moves down during the expansion phase of the engine cycle, and supply cooling air to film holes in the piston head.

Film cooling holes can be placed at any angle, be any shape, and be in any location on the cylinder, piston, or dome combustor. The locations shown here are examples, and do not limit the potential patterns. In brief, film cooling holes are strategically placed to cool any hot component in the engine, such as the valves or piston head. They are also placed to purge tight spaces, and they are placed to accomplish any combination of those tasks.

Film Plenum in the Piston Head

Figure 23:
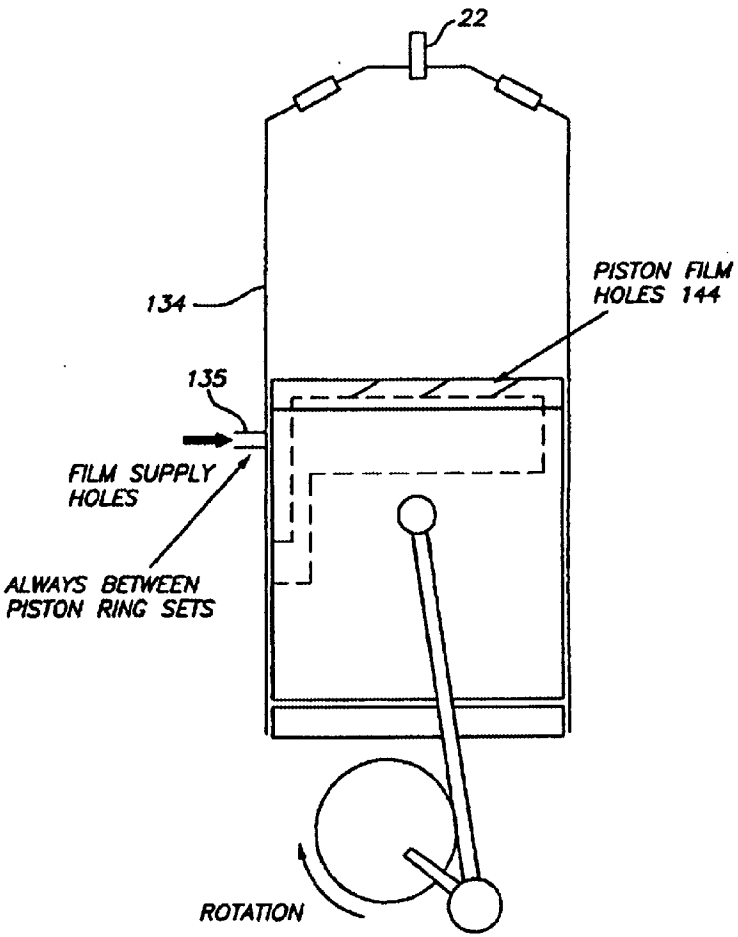
FIG. 23 is a view similar to FIG. 22 in which the piston is nearer the open end of the cylinder.
Figure 22:
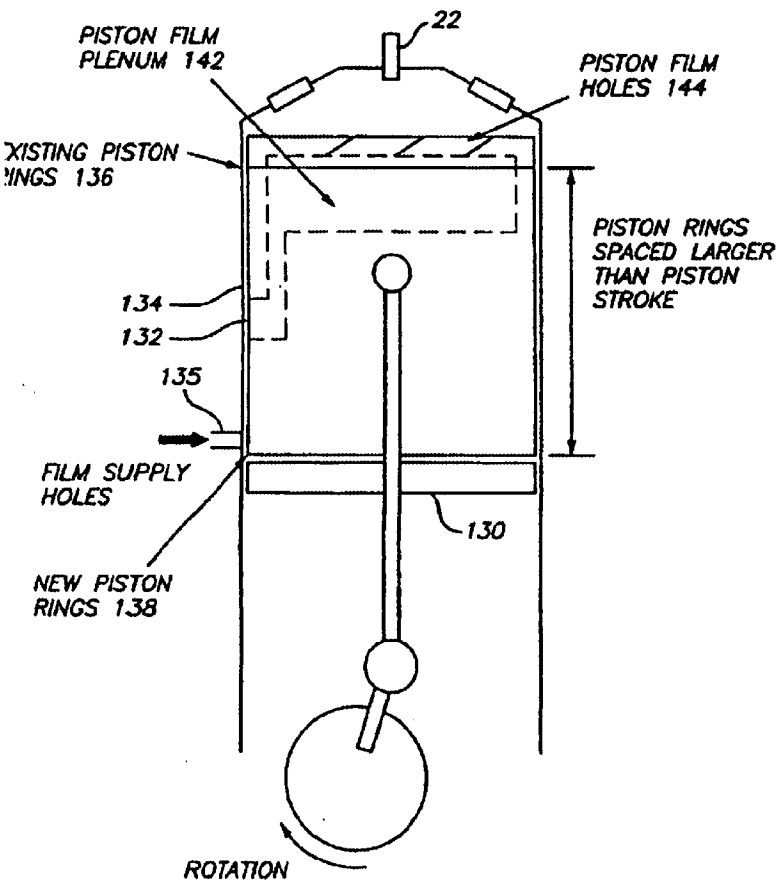
FIG. 22 is a block diagram showing an IC engine in which the piston is provided with cooling film holes, and with the piston close to the closed end of the cylinder.
Figure 24:
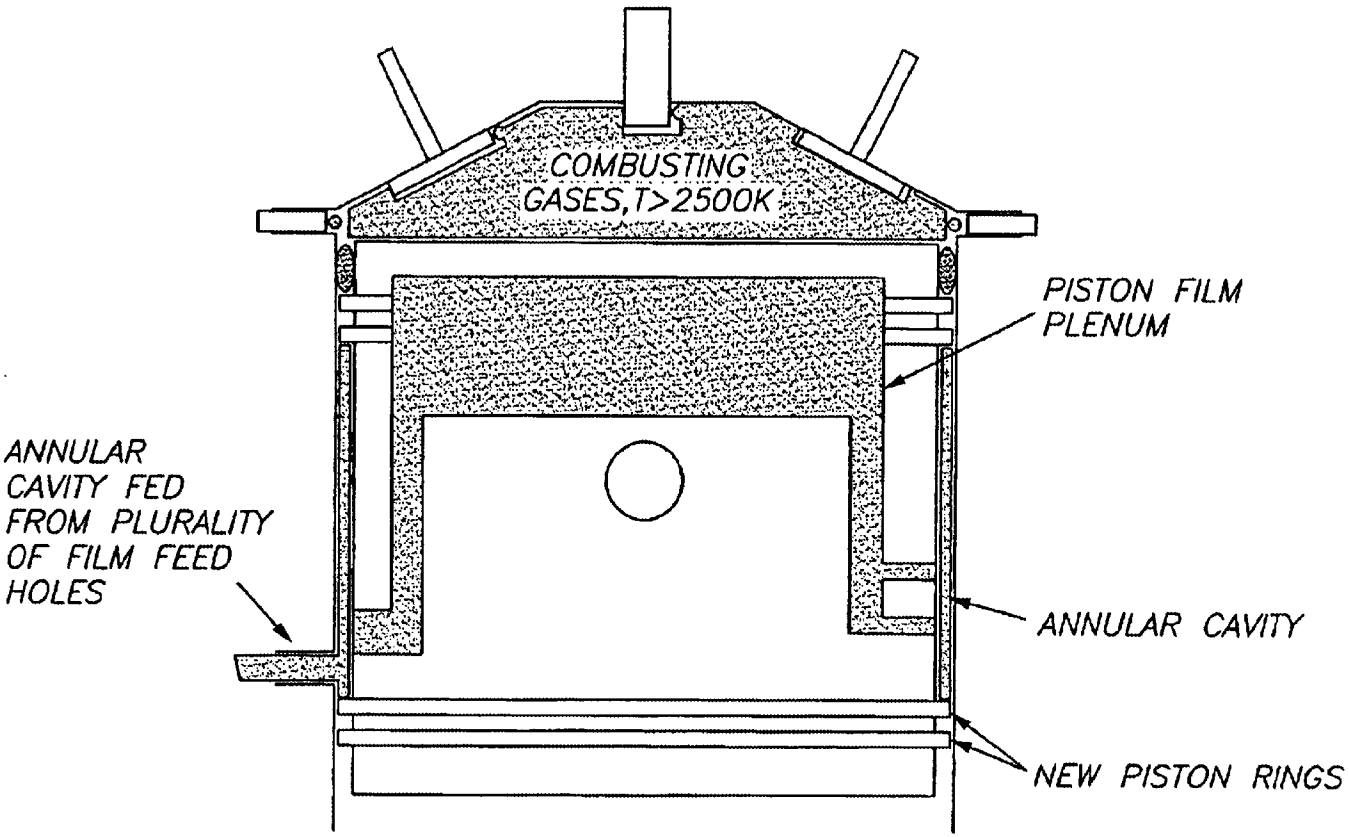
FIG. 24 is a schematic diagram showing how film-cooling gas is delivered to the piston of the engine shown in FIGS. 22 and 23.

Referring to FIGS. 22–24, to feed film-cooling air to a piston 130, an annular cavity 132 between the piston and a surrounding cylinder 134 is pressurized with film air from a compressor and control valve (not shown in FIGS. 22–24) through one or more supply lines 135. The piston carries a first set of conventional piston rings 136 around an upper part of the piston. A second set of piston rings 138 are disposed around a lower part of the piston. The annular area between the piston and cylinder, and bounded top and bottom by the two sets of piston rings forms the pressurized cavity 132. A piston film plenum 142 in the piston is fed from this cavity. Piston film holes 144 extend from the plenum 142 to the surface of the piston head to provide a cooling air film as previously described. The piston is longer than the stroke so that film supply lines feeding the annular cavity are always between the piston rings. This ensures that the annular cavity is always connected to the film supply lines.

The annular cavity 132 also feeds leaks around the piston rings into the combustion chamber, cooling the cylinder walls. If these leaks are not enough, grooves are cut into the piston rings to form film holes or controlled leaks.

Figure 25:
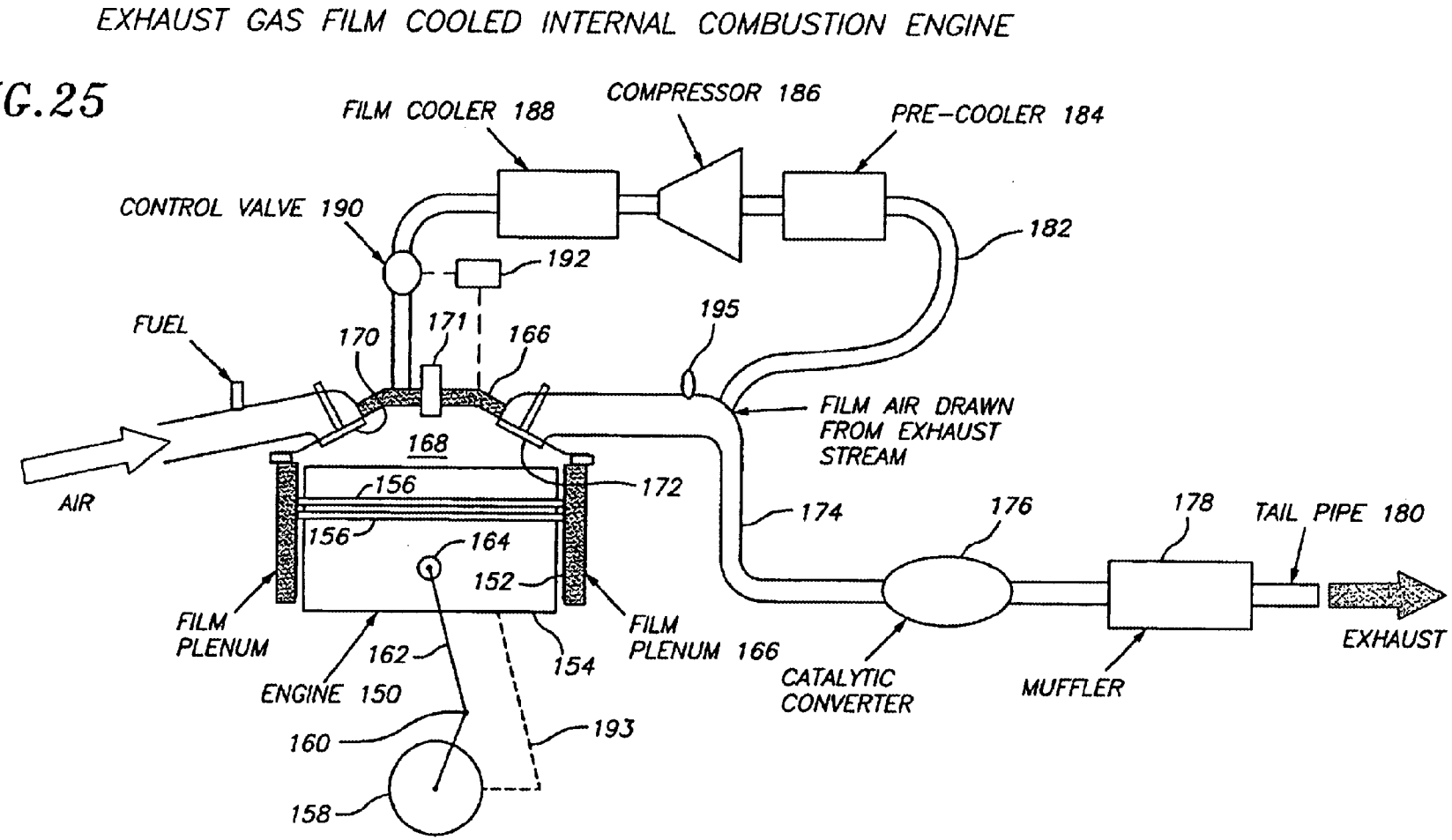
FIG. 25 is a schematic diagram of a film-cooled IC engine using exhaust gas from the engine at the cooling gas.

Referring to FIG. 25, in an alternate embodiment of the present invention, an exhaust gas film-cooled internal combustion engine 150 includes a cylinder 152, and a piston 154 with piston rings 156. A crankshaft 158 is connected by crank pin 158 to a connecting rod 162, which is connected by wrist pin 164 to the piston. A film plenum 166 surrounds the exterior of the cylinder and cylinder head as previously described.

A mixture of fuel and air is admitted to a combustion chamber 168 through an intake valve 170. A spark plug 171 ignites the compressed mixture of fuel and air during the combustion phase. Exhaust gas leaves the combustion chamber through an exhaust valve 172, and flows through an exhaust manifold 174, a catalytic converter 176, a muffler 178, and a tail pipe 180. Exhaust gas from the exhaust manifold also flows through a bypass conduit 182, a precooler 184, a compressor 186, a film cooler 188, a control valve 190 and into the film plenum 166, which surrounds the cylinder and cylinder head, as previously described. A controller 192 senses the crank angle of the crankshaft through a linkage 193, and controls the operation of control valve 190 to inject a film of cooled exhaust gas at appropriate times in the cycle as previously described. An oxygen sensor 195 senses the presence of oxygen in the exhaust gas, and regulates fuel flow to reduce oxygen content in a manner known to those skilled in the art.

Figure 26:
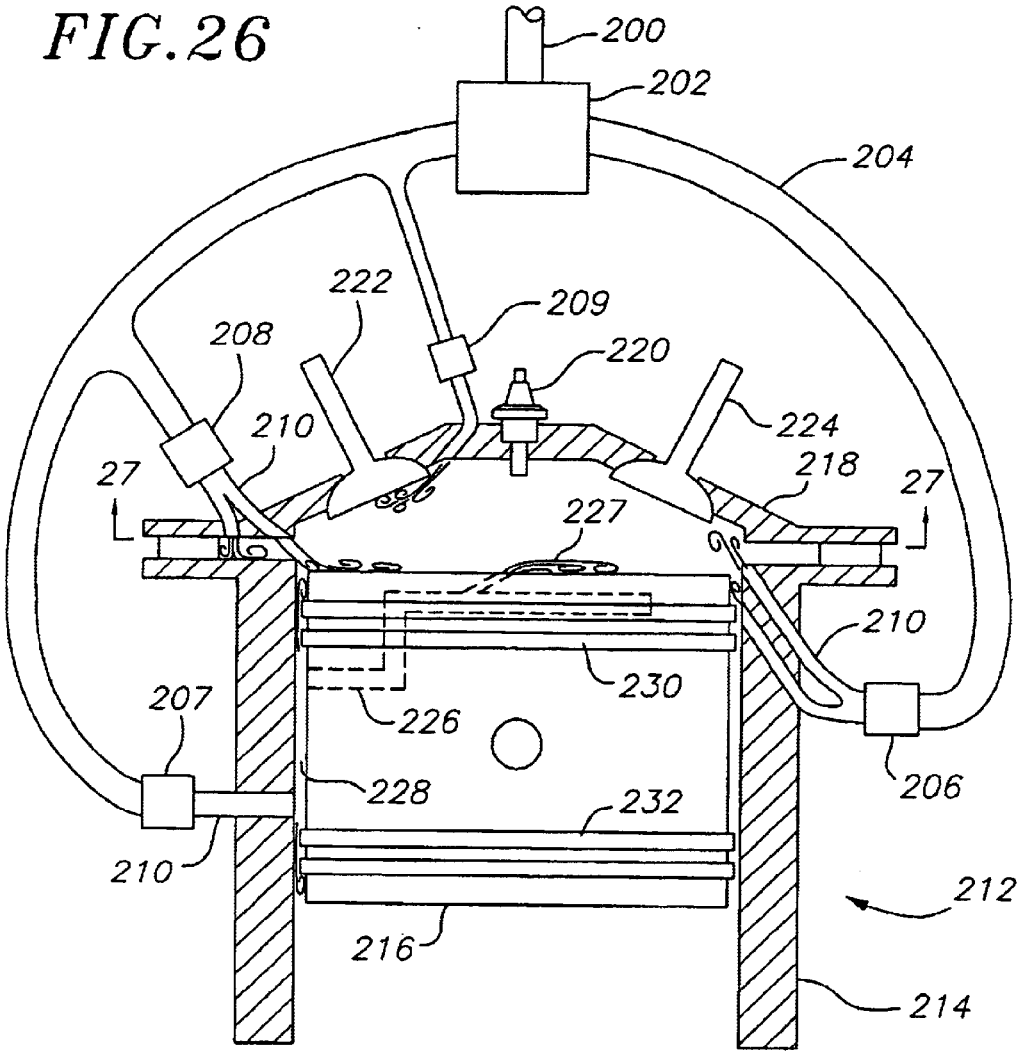
FIG. 26 is a schematic diagram of an internal combustion engine using a plurality of control valves for regulating the injection of a film-cooling gas into different areas of the engine.

Referring to FIG. 26, compressed gas, for example, air, flows through a supply line 200 to a pressure regulator 202 and into a manifold 204, which supplies the high pressure gas through first, second, third, and fourth control valves 206, 207, 208 and 209, respectively. Each control valve delivers film-cooling gas through respective capillaries 210 (cooling channels and film holes) to various areas of an internal combustion engine 212, which includes a cylinder 214, a piston 216 and cylinder head 218 which is provided with the usual spark plug 220, intake valve 222 and exhaust valve 224. A cooling channel (and film hole) 226 in the piston delivers a stream 227 of cooling gas across the top surface of the piston, and opens into an annular space 228 between the interior surface of the cylinder and the exterior surface of the piston between upper piston rings 230 and lower piston rings 232. As shown in FIG. 26, the piston is near the upper end of its stroke, which is less than the distance between the upper and lower piston rings so that the capillary 210 always opens into the annular space 228. The usual crank shaft, connecting rod, and sensor for measuring crankshaft angle and sending appropriate signals to the control valves are not shown in FIG. 26 because these elements have been described above in connection with the other embodiment.

In the film-cooled internal combustion engine of this invention, the control valves are timed to open during the compression, combustion, or expansion phases of the engine cycle. It is advantageous not to open all the control valves during the entire compression, combustion and expansion phases. Examples of reasons for opening different control valves at different times are set forth below.

Spark Plug

The cooling channels or capillaries which discharge a film of cooling gas in the vicinity of the spark plug would dilute the fuel-to-air ratio, possibly hindering ignition, if injected before the spark. Therefore, the control valve for capillaries pointing at or near the spark plug open after the spark, and need not be open at all during the intake phase.

Tight Spaces

Purging fuel from the tight spaces in the combustion chamber to make the fuel available for combustion is completed before the spark. Therefore, those capillaries which open into tight spaces get supply gas before the spark. These capillaries can be fed from a relatively low pressure air supply, that is, at a pressure higher than a maximum pressure reached during the compression phase, namely, about 10 atmospheres. The high pressure air supply for other phases of engine operation must be higher than the maximum pressure in the engine cycle, e.g., greater than about 30 atmospheres.

Temperature-Sensitive Parts

Some parts of the engine experience thermal stress faster than others. For this reason, capillaries are directed at the intake in exhaust valves to protect them. These capillaries are supplied gas throughout the compression, combustion and expansion phases to get maximum thermal protection.

Staging

Regions relatively far from the spark plug are purged of combustion gases before the spark to form a buffer that lasts through the combustion process. This buffer is formed by supplying gas to appropriately located capillaries during the compression phase, allowing the gas from these capillaries to displace relatively large volumes of combustion gases.

These capillaries are closed at the spark.

Suppression of Auto-Ignition

A controlling factor for engine efficiency is compression ratio. The limit for raising the compression ratio is the auto-ignition of the fuel, which ignites because of compression heating combined with heating through convection from the walls of the engine. Thus, auto-ignition begins against the walls. In accordance with this invention, the location of local "hot spots" which cause auto-ignition are identified, and a cooling film is directed to these locations, stopping the auto-ignition, and allowing the compression ratio of the engine to be increased.

Figure 27:
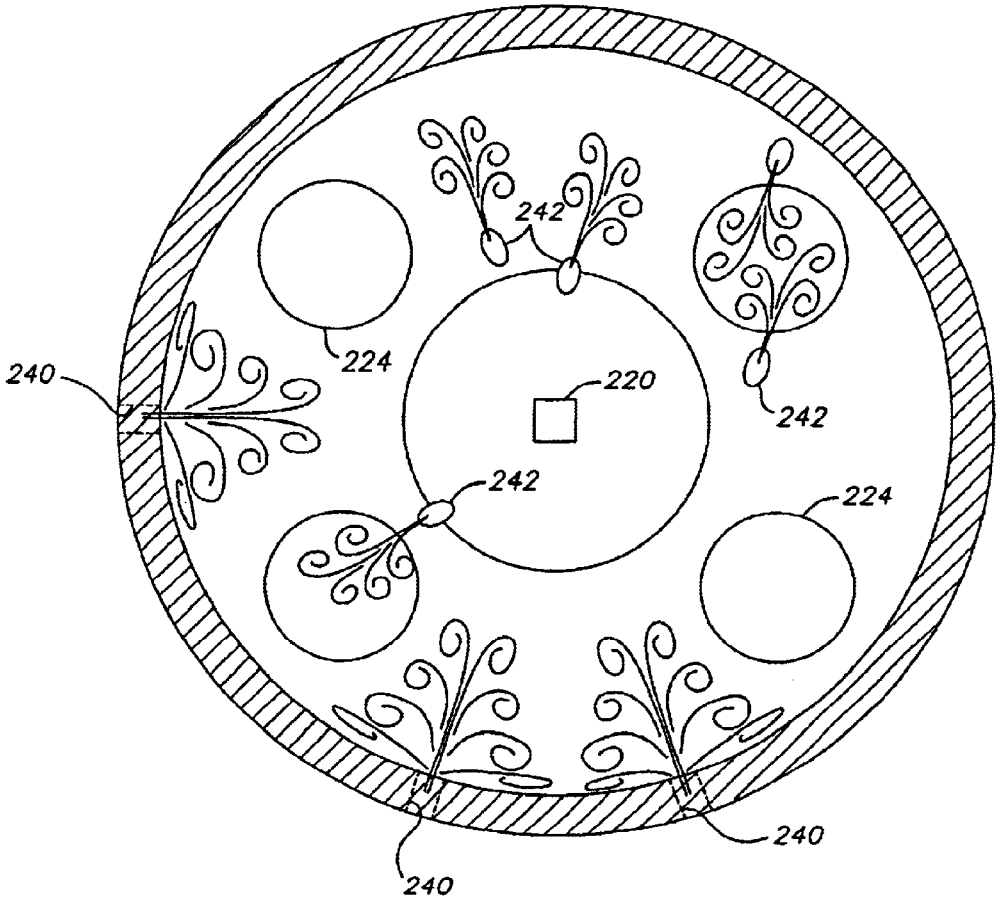
FIG. 27 is a view taken on line 27—27 of FIG. 26 showing a distribution pattern for various film-cooling gas streams.

FIG. 27, a view taken on line 27—27 of FIG. 26, shows an example of three capillaries 240 (cooling channels and film holes) spaced around the periphery of the combustion chamber for injecting cool films inwardly across the downwardly facing inner surface of the combustion chamber, or across the top surface of the piston when it reaches a position of top dead center. Other capillaries 242 (cooling channels and film holes) open through a central portion of the cylinder head to direct streams of cooling gas across the exhaust valves 222, or to urge fuel from around intake valves 224 at appropriate intervals during the compression, combustion, and expansion phases of the engine cycle.

Figure 28:
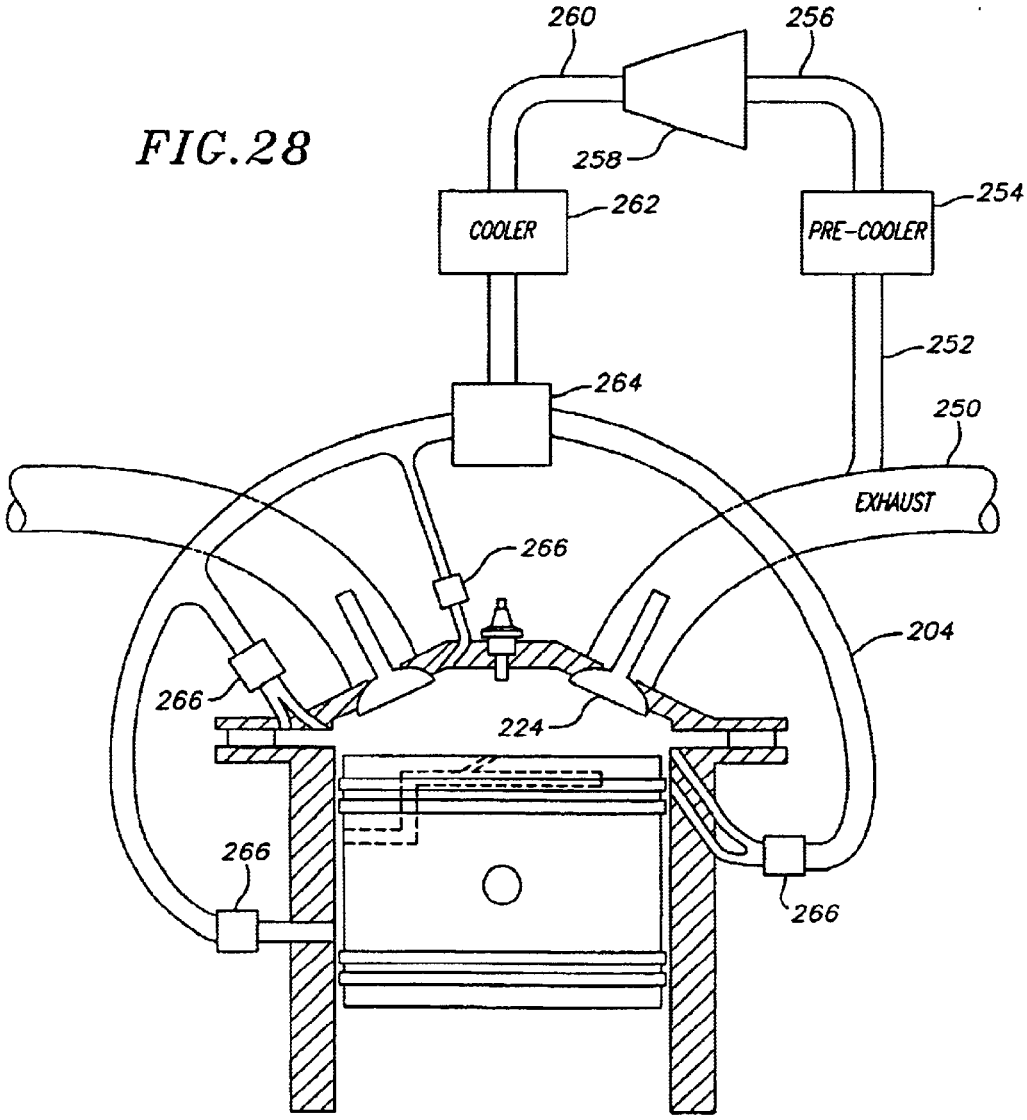
FIG. 28 is a schematic diagram of an internal combustion engine with a plurality of control valves for regulating the injection of cooled and compressed exhaust gas into various areas of the engine.

Referring to FIG. 28, which is a view similar to that of FIG. 26, and in which the same reference numerals are used to identify corresponding parts, an exhaust manifold 250 carries exhaust gas away from the engine during the exhaust phase of the engine cycle. A bypass line 252 takes some exhaust gas through manifold 250 and passes it through a precooler 254, and into the intake 256 of a compressor 258. Compressed exhaust gas flows from a compressor outlet 260 through a cooler 262, and into a pressure regulator 264, which delivers cooled compressed exhaust gas into an injection manifold 204, which supplies cooling films of exhaust gas to control valves 266 as previously described with respect to FIG. 26.

The advantage of using exhaust gas for the cooling film is that little or no oxygen is present in it. Oxygen stops the chemical reactions in most catalytic converters, causing high concentrations of carbon dioxide, nitrogen oxides, and unburn hydrocarbons to be exhausted to the atmosphere. By using oxygen-free exhaust gas, no oxygen is injected into the cylinder, and consequently does not reach the catalytic converter.

Effect of Film Cooling Internal Combustion Engines

Figure 20:
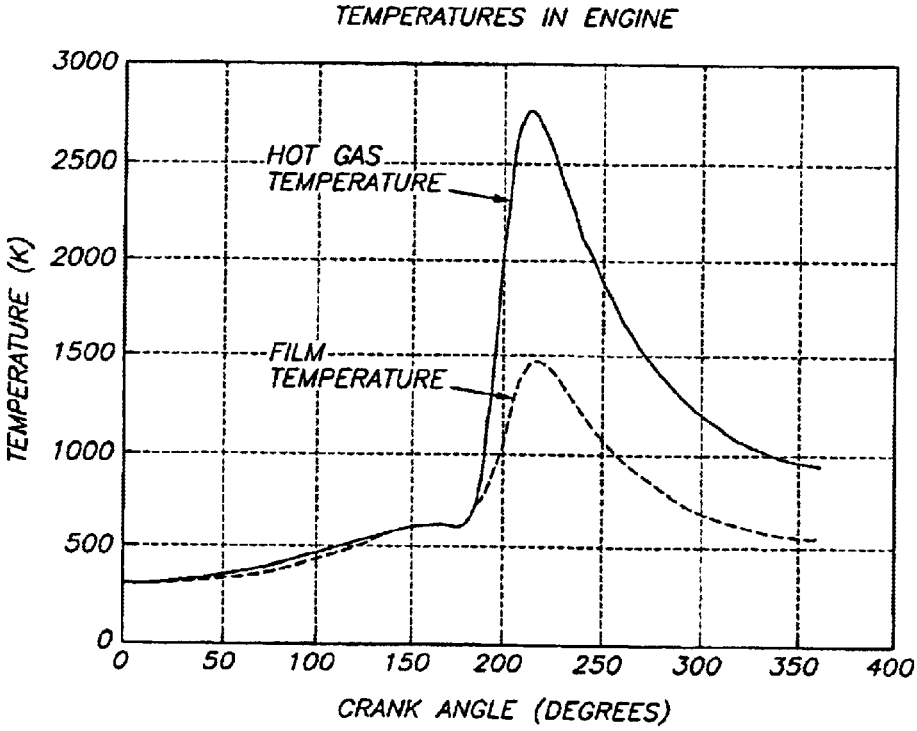
FIG. 20 is a plot of IC engine temperature versus crank angle for the combustion gas and for the film of cooling air.

An objective of film cooling the internal combustion engine, whether gasoline or diesel, is to reduce the heat transfer to the metal components of the engine from the hot gases to cause more work to be extracted from those gases, and thereby raise the efficiency of the engine: This goal may be achieved by reducing the temperature of the air coming in contact with metal parts during the power stroke of the engine by laying down a thin film of air between the hot gases and the walls. This thin film creates an effectively lower film temperature driving convection heat transfer. FIG. 20 shows the hot gas temperature in the engine and the film temperature driving convection as a function of crank angle.

Figure 21:
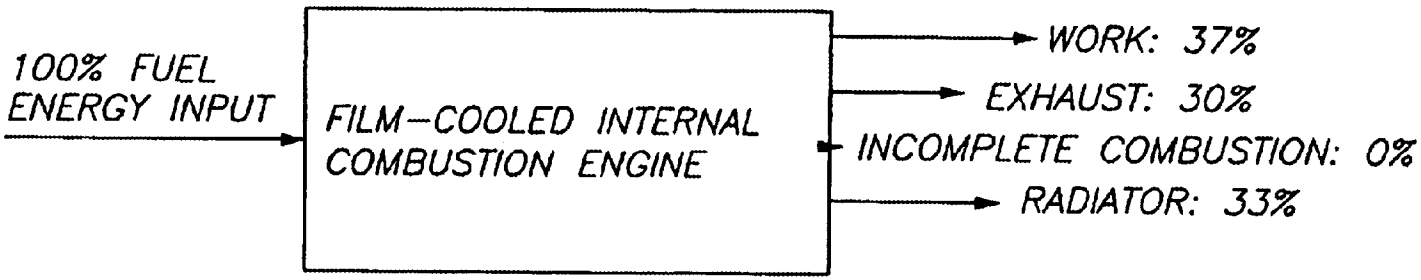
FIG. 21 is a block diagram showing the energy distribution of a film-cooled IC engine.

FIG. 21 shows efficiency and energy distribution for the film-cooled engine of this invention.

Although the invention has been explained with reference to 4-stroke engines, it also can be used in 2-stroke or other types of engines. In addition, the control valves can be operated in response to pressure within the engine cylinder, or in response to piston position, as well as other engine indicators. Further, the gases may be nitrogen, other noble or inert gases or other gases or fluids for reducing the convected heat transfer within the cylinder.

I claim:

1. An IC engine comprising a cylinder, a piston which reciprocates in the cylinder to define a combustion chamber with interior surfaces, an inlet and an outlet into the combustion chamber, the inlet and the outlet opening and closing as the piston reciprocates in the cylinder so the piston periodically passes through intake, compression, combustion, expansion and exhaust phases, a supply of compressed gas exterior of the combustion chamber, at least one cooling channel passing from the exterior to the interior of the cylinder wall connected to the compressed gas supply for directing a flow of compressed gas through a film hole and against an interior surface of the combustion chamber to reduce heat transfer to the surface, and a control valve for controlling flow of gas into the cooling channel during the compression, combustion or expansion phases, in which the piston includes at least one cooling channel and film hole for receiving the compressed gas and directing a flow of compressed gas past the external surface of the piston, and a supply conduit extending through the cylinder wall to deliver air from the supply of compressed gas to the cooling channel and film hole in the piston.

2. An engine according to claim 1, which includes a tight space in the combustion chamber where fuel is trapped, and which includes a fuel-purging channel extending through the cylinder wall to deliver compressed gas through a film hole for purging trapped fuel from the tight space within the combustion chamber.

3. An engine according to claim 1 in which the controller operates the control valve to prevent flow of gas into the cooling channel during the intake phase.

4. An engine according to claim 1, which includes a channel extending into the combustion chamber to deliver gas from the supply of compressed gas through a film hole against temperature sensitive parts of the engine in order to reduce the temperature of those parts.

5. An engine according to claim 1, which includes a channel extending into the combustion chamber to deliver gas from the supply of compressed gas through a film hole against regions of the combustion chamber prone to auto-ignition of fuel.

6. An engine according to claim 1 in which the supply of compressed gas is exhaust gas taken from the engine.

7. An IC engine comprising a cylinder having a wall with an interior surface, a piston which has an exterior surface and which reciprocates in the cylinder to define a combustion chamber, an inlet and an outlet into the combustion chamber which opens and closes as the piston reciprocates in the cylinder so the piston periodically passes through intake, compression, combustion, expansion and exhaust phases, a compressor having an inlet and an outlet, the compressor inlet being connected to receive exhaust gas from the engine, and at least one cooling channel passing from the exterior to the interior of the cylinder, the cooling channel being connected to the compressor outlet for directing a flow of exhaust gas through a film hole against the interior surface of the cylinder wall.

8. An IC engine comprising a cylinder having a wall with an interior surface, a piston which has an exterior surface and which reciprocates in the cylinder to define a combustion chamber, an inlet and an outlet into the combustion chamber which opens and closes as the piston reciprocates in the cylinder so the piston periodically passes through intake, compression, combustion, expansion and exhaust phases, a compressor having an inlet and an outlet, the compressor inlet being connected to receive exhaust gas from the engine, and at least one cooling channel passing from the exterior to the interior of the cylinder, the cooling channel being connected to the compressor outlet for directing a flow of exhaust gas through a film hole against the interior surface of the cylinder wall, wherein the engine further includes a cooler for cooling compressed exhaust gas from the compressor before the compressed exhaust gas contacts the interior surface of the cylinder wall.

9. An engine according to claim 7 or 8 in which includes a cooler for cooling exhaust gas before the gas enters the compressor.

10. An engine according to claim 7 or 8 which includes a control valve for controlling flow of exhaust gas into the cooling channel, and a controller responsive to the crank angle of the engine and connected to the valve for injecting exhaust gas into the cooling channel and out the film hole only during the compression, combustion or expansion phases.

11. An IC engine comprising a cylinder having a wall with an interior surface, a piston which has an exterior surface and which reciprocates in the cylinder to define a combustion chamber, an inlet and an outlet into the combustion chamber which opens and closes as the piston reciprocates in the cylinder so the piston periodically passes through intake, compression, combustion, expansion and exhaust phases, a compressor having an inlet and an outlet, the compressor inlet being connected to receive exhaust gas from the engine, and at least one cooling channel passing from the exterior to the interior of the cylinder, the cooling channel being connected to the compressor outlet for directing a flow of exhaust gas through a film hole against the interior surface of the cylinder wall, wherein the engine further includes a control valve for controlling flow of exhaust gas into the cooling channel, and a controller responsive to the crank angle of the engine and connected to the valve for injecting exhaust gas into the cooling channel and out the film hole only during the compression, combustion or expansion phases, and a sensor for detecting the presence of oxygen in the exhaust gas entering the compressor.

12. An engine according to claim 10 in which the controller operates the valve to prevent flow of exhaust gas into the cooling channel and out the film hole during the intake phase.

13. A method for reducing heat transfer in an internal combustion engine having a cylinder, the method comprising pressurizing fluid, and injecting the fluid into the cylinder through a fluid supply such that the fluid impinges on an internal surface of the cylinder, thereby reducing convected heat transfer from the gases in the cylinder to components of the engine, wherein pressure of the supply of the fluid is less than peak pressure in the engine, and wherein the supply of fluid never supplies fuel for the engine.

14. The method of claim 13 wherein the fluid is a compressed gas.

15. The method of claim 14 wherein the fluid is exhaust gas.

16. An engine according to claims 1, 7, or 11 wherein the cooling channel has a first end and a second end, the first end being connected to the compressed gas supply, and the second end extending to, but not within, the interior of the combustion chamber.

17. An IC engine comprising a cylinder, a piston which reciprocates in the cylinder to define a combustion chamber with interior surfaces, a supply of compressed gas exterior of the combustion chamber, at least one cooling channel passing from the exterior to the interior of the cylinder wall connected to the compressed gas supply for directing a flow of compressed gas through a film hole and against an interior surface of the combustion chamber, wherein pressure of the supply of compressed gas is less than peak pressure in the engine, and wherein the supply of compressed gas never supplies fuel for the engine.

18. An engine according to claim 17, wherein the gas is exhaust gas from the engine.

19. An engine according to claim 17, which includes a channel extending into the combustion chamber to deliver gas from the supply of compressed gas through a film hole against regions of the combustion chamber prone to auto-ignition of fuel.

* * * * *